United States Patent [19]

Taylor

[11] Patent Number: 4,632,396

[45] Date of Patent: Dec. 30, 1986

[54] BOWLING BALL

[76] Inventor: Wilson G. Taylor, P.O. Box 146, San Gabriel, Calif. 91776

[21] Appl. No.: 551,367

[22] Filed: Nov. 14, 1983

[51] Int. Cl.[4] ..... A63B 37/00

[52] U.S. Cl. ..... 273/63 A; 273/63 B; 156/94

[58] Field of Search ..... 273/63 A, 63 B, 64, 273/65 EG, 128 A; 156/94

[56] References Cited

U.S. PATENT DOCUMENTS

| | | | |
|---|---|---|---|
| 2,274,522 | 2/1942 | Bomze | 273/63 A |
| 3,129,002 | 4/1964 | Bednash | 273/63 B |
| 3,329,429 | 7/1967 | Kopperud | 273/63 A |
| 3,784,198 | 1/1974 | Bach | 273/63 A |

FOREIGN PATENT DOCUMENTS

| | | | |
|---|---|---|---|
| 538234 | 3/1922 | France | 273/63 A |
| 241220 | 7/1946 | Switzerland | 273/63 A |

*Primary Examiner*—George J. Marlo
*Attorney, Agent, or Firm*—Pretty, Schroeder, Brueggemann & Clark

[57] ABSTRACT

A unique hand grip is provided for a bowling ball wherein the lifting fingers work in unison to provide a single balanced lifting force directed toward the thumb. This is accomplished by use of an appropriately sized elliptical finger cavity which receives a bowler's middle and ring fingers therein. An alternative embodiment encompassing two thumb holes provides two separate grips utilizing the same elliptical cavity to obtain distinct and separate performance characteristics in a single bowling ball. Finally a method is provided for rehabilitating a conventional bowling ball and improving it by the removal of the traditional finger holes therefrom and the addition of an elliptical cavity as a replacement therefor.

7 Claims, 6 Drawing Figures

BOWLING BALL

FIELD OF THE INVENTION

The present invention relates generally to bowling balls and, more particularly, to a bowling ball gripping arrangement which facilitates improved control by the bowler during delivery.

BACKGROUND OF THE INVENTION

Early bowling balls were provided with two cylindrical holes: one for the thumb and the other for the middle finger. Later, because of difficulty in holding the weight of the ball and also to obtain better control during the delivery there came into general use a ball with three cylindrical holes: one for the thumb and the other two for the middle and ring fingers. Typically, the middle and ring finger holes are spaced from the thumb hole a sufficient distance to allow the ball to be held firmly, but comfortably, with the first and second phalanges completely inserted therein. In a three-hole ball, the middle and ring finger holes are in close proximity to each other to permit gripping of the ball without hand distortion. The ball is thus held by reason of a clamping action exerted by the thumb and the fingers in addition to the friction between the sides of the holes and the fingers.

While the three-fingered ball is in most common use today, primarily due to the relatively high standard weight of bowling balls, it is generally considered that the two-hole ball produces a more accurate delivery. This is due primarily to the difficulty of coordinating the two middle fingers so that they will release the bowling ball simultaneously. A small difference in the time of release by the two middle fingers significantly affects the ball trajectory resulting in a loss of accuracy.

To achieve a high degree of proficiency in the sport of bowling, it is essential that the ball properly and comfortably fit the hand and fingers of the individual bowler (particularly when a three-hole ball is used). The fit around the thumb should be just loose enough for comfort yet tight enough to maintain a frictional grip when the thumb is bent at the joint and removed from the hole upon delivery of the ball. The holes for the other fingers should fit with the same degree of looseness. When the holes are too small, the fingers soon become irritated, torn and scraped because the fingers have a tendency to expand after a few balls have been thrown. When the holes are too large, it is difficult to hold the ball properly possibly resulting in the ball slipping out of the bowler's hand prematurely during the delivery.

To eliminate the tendency for the ball to leave the bowler's hand prematurely, various expediences have been proposed such as the use of chalk and other sticky material and the provision of liners for the holes made of compressible and yieldable material such as cork, soft rubber or another resilient material. It has also been suggested to corrugate the inside surfaces of the holes, to otherwise roughen the wall surfaces, and to provide inserted hard liners having rough areas. While these techniques can provide a certain degree of friction for gripping purposes, they tend to cause abrasion and soreness of the fingers.

The most common means for fitting a bowling ball involves the use of a spherical assembly having two sections rotatable relative to each other, each section including numerous holes for insertion of the thumb and bowling fingers. The bowler inserts each of his bowling fingers and thumb into the various holes until he selects those which appear to have a proper degree of clearance, or from which the optimum hole diameter may be estimated. Having done so, he then reinserts his thumb into the hole most closely approximating his optimum size, and rotates the opposite section of the assembly until he locates two adjacent finger holes thereon most closely approximating a comfortable span for his hand, the finger span being measured from the base of the thumb. The selected ball is then drilled to those span and hole diameter specifications. The slightest error in either the finger span measurements or the drilling of the finger holes adversely affects the performance of the bowler in a significant way.

Errors in the measuring or drilling process result in an unequal distribution of the load upon the fingers. In due course an overloaded finger may suffer serious finger strain or a more severe injury such as a torn ligament. In addition to finger injury, inaccurately measured finger spans and imprecisely drilled holes cause the fingers to lift different loads. These differing loads make it very difficult, if not impossible, to extract the fingers from the holes simultaneously as is desired to obtain the most accuracy.

Another consequence of drilling separate finger holes designed to match the differing finger sizes and spans of the middle and ring fingers is that the "pitch" of each finger hole may be different. "Pitch" is defined as the angular and linear differences of the longitudinal axis of a hole or cavity with respect to the center of the ball. When the "pitch" of each finger hole is different, the lifting leverage of each finger can be different with respect to the other, thereby causing non-uniform forces to be directed toward the thumb hole and resulting in an inaccurate delivery.

Various methods and devices designed to remedy the aforementioned problems have been proposed over the years, and examples can be found in U.S. Pat. Nos. 2,274,522; 2,347,771; 2,482,190; 2,991,079; 3,329,429, 3,454,440; and 4,150,822. Nevertheless, satisfactory ball constructions which take into account the different finger spans of the individual fingers, remedy the problems presented by different "pitches" of the finger holes, and eliminate unequal load distribution between the lifting fingers in order to insure the simultaneous release of the lifting fingers and the accurate delivery of the bowling ball have not been found.

Accordingly, there is a need to alter and control the individual lifting forces originating from separate and distinct points and, so far as possible, merge these forces into a single lifting force predictably directed from the lifting edge of the finger holes toward the thumb. Additionally, it is desirable that a device be provided which allows for as much flexibility and utility in the use of a single ball as is practicable. For example, a single ball which provided a finger-tip grip as well as a conventional grip, each with its own performance characteristics, would be desirable for the bowler interested in obtaining the different performances of two balls in one. Finally, there is also a need for a gripping arrangement which enhances the bowler's control and comfort by accounting for differing finger spans, remedying "pitch" difference problems, and eliminating unequal load distributions.

SUMMARY OF THE INVENTION

The present invention resides in a unique bowling ball construction that accomplishes objectives such as those set forth above. Additionally, a method is provided for rehabilitating a conventional bowling ball and improving it by the addition of a unique grip.

More specifically, the ball of the invention is substantially spherical, having at least one hole designed and shaped to receive the bowler's thumb and an elliptical cavity situated to accomodate one or more fingers. This configuration enables the forces exerted by the lifting fingers to be merged into a single force directed toward the thumb hole by a curved lifting wall. The lifting wall allows the pressure point on each lifting finger to shift minutely in response to the finger span differences of each finger, thereby assuring an equally divided load.

The curvature of the ellipse must provide sufficient snugness for the backs of the fingers without allowing the pressure points to shift too far away from one another, thereby creating a feeling of discomfort on the sides of the fingers and weakening the single lifting force feeling as the two fingers work in unison.

Older conventional bowling balls which have been found by their owners to be ineffective and undesirable may be rehabilitated by drilling a large cavity over the site of the old finger holes and placing therein a plug containing an appropriately sized and shaped elliptical cavity which may be used to form a new grip in conjunction with the old thumb hole.

In one embodiment of the invention a large spherical bowling ball is provided with a thumb hole and a recess situated near the thumb hole. The recess is substantially filled by a plug that contains an elliptical cavity that accepts a bowler's fingers. It has been found that best results are obtained with a cavity that approximates a 30 to 35 degree ellipse and dimensioned so that when the bowler's fingers are inserted they loosely contact the inner wall of the cavity on the side away from the thumb hole.

This embodiment of the invention makes it possible to alter the rolling and hitting characteristics of the ball by providing a plug comprised of a material of different density than the rest of the bowling ball. Similarly, the plug may be removed and replaced with another of a different density when different rolling and hitting characteristics are sought. Also, the cavity within the plug may be provided a "pitch" which is different from the "pitch" of the thumb hole or the cavity. "Pitch" is defined as the angular and linear differences of the longitudinal axis of a hole or cavity with respect to the center of the ball.

A second embodiment relates to a ball having a recess and two thumb holes, each thumb hole being diametrically opposite the other in relation to the recess. A plug is included to substantially fill the recess, and it defines an elliptical cavity capable of accommodating one or more of the bowler's fingers.

The elliptical cavity may be positioned in the plug so that the distance between the first thumb hole and the cavity is different than the distance between the second thumb hole and the cavity. By providing these different finger spans between the thumb holes and the cavity, two completely different sets of performance characteristics may be obtained.

Finally, a method is provided whereby a conventional bowling ball may be rehabilitated and improved by drilling out a recess over the location of the previously existing finger holes and filling that recess with a plug defining an elliptical cavity. The plug is bonded to the ball in a position which allows the bowler's fingers to easily fit within the cavity when the thumb is placed within the existing thumb hole. Additionally a second thumb hole may be drilled diametrically opposite the first thumb hole with respect to the recess and positioned to create different throwing characteristics than the first thumb hole.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
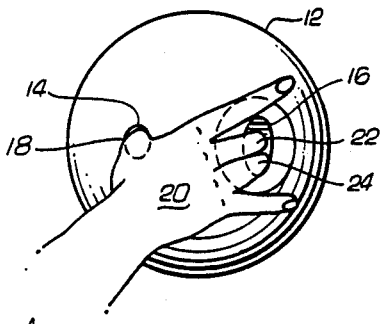
FIG. 1 is a perspective view of a bowling ball embodying the improved gripping arrangement of this invention and the manner in which a bowler's fingers would be inserted therein.
Figure 2:
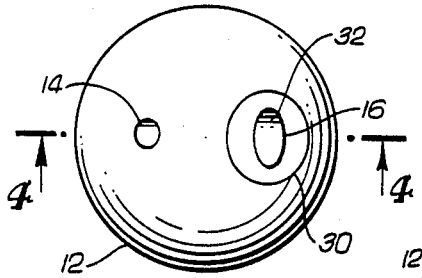
FIG. 2 is a perspective view of a bowling ball embodying the gripping arrangement of this invention without a bowler's hand shown thereon.

A spherical bowling ball 12, of traditional construction, is supplied with a thumb hole 14 and an elliptical finger cavity 16, as shown in FIGS. 1 and 2. The thumb hole 14 must be situated near enough to the cavity 16 so that when the thumb 18 of a bowler's hand 20 is inserted, the middle finger 22 and the ring finger 24 can be comfortably placed within the cavity. The bowler can insert his fingers sufficiently to grasp the bowling ball 12 with the first, second or both phalanges of those fingers.

Figure 3:
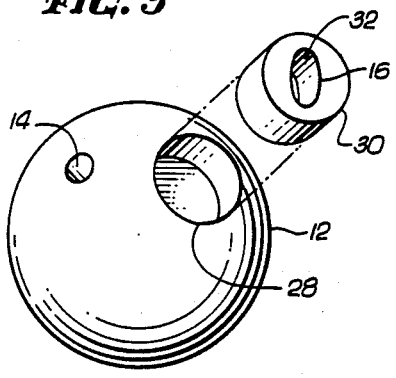
FIG. 3 is an exploded view of the bowling ball of FIG. 2.
Figure 4:
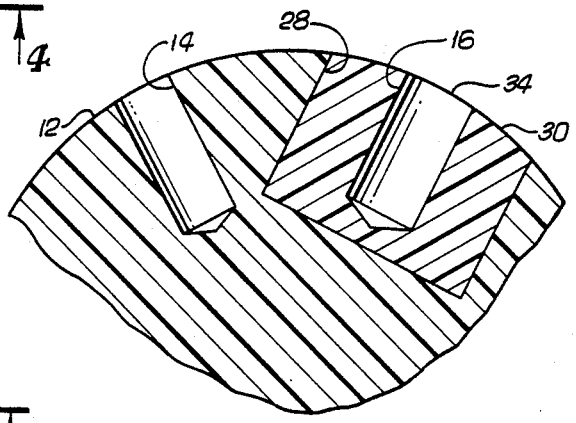
FIG. 4 is an enlarged fragmented sectional view taken generally along line 4—4 of FIG. 2, illustrating the relationship of the thumb hole and elliptical finger grip with respect to the center of the bowling ball.

As best illustrated by FIGS. 3 and 4, the ball 12 is initially provided with the thumb hole 14 and a recess 28 in the area where the cavity 16 is to be located. A cylindrical plug 30 substantially fills the recess 28 (FIG. 4).

The plug 30 is constructed of a material that is easily bonded to the ball 12. It may be of a different density than the ball 12 as desired to affect balance. A resilient plastic material is best suited for the construction of the plug 30.

The cavity 16 is formed within the plug 30, being dimensioned and shaped to comfortably receive the bowler's fingers 22 and 24. It has been found that a 30 to 35 degree ellipse that loosely accepts the bowler's fingers yet contacts both sides of the fingers while they are inserted is the preferred configuration. The inner walls 32 of the cavity 16 are curved so as to follow the general shape and dimensions of a surface ellipse 34.

When the plug 30 is positioned satisfactorily to accommodate one or more of the bowler's fingers 22 or 24, it is bonded to the ball 12 to form an integral unit. Should the bowler desire to replace the plug 30 for whatever reason, it may be removed and repositioned or replaced with another plug, thereby enhancing the utility and flexibility of use of a single ball.

In the ball 12, the individual lifting forces of the bowler's fingers 22 and 24 are merged into a single lifting force directed toward the thumb 18. Differences between finger spans are accommodated by the curved lifting edge of the inner walls 32 of the cavity 16, allowing each fully spanned finger 22 and 24 to be met by the wall 32 at its most natural point. The curvature of the lifting wall 32 allows the pressure point on each lifting finger 22 and 24 to shift minutely in response to finger span differences, thereby assuring an equally divided load between each of the fingers. Additionally, the plug 30 may be customized to provide "feel" characteristics not attainable by simply drilling cylindrical holes in the conventional manner. For example, the inner walls 32 of the cavity 16 may be smooth, rough, or provided with an interior surface with different frictional characteristics than that of the ball 12 itself.

Additionally, it is possible to alter the rolling and hitting characteristics of the ball 12 by providing a plug 30 comprised of a material of different density than the rest of the bowling ball. Similarly, the plug 30 can be removed from the recess 28 and replaced with another plug of a different density when different rolling and hitting characteristics are sought. Also, the elliptical finger cavity 16 can be constructed with a "pitch" which is different from the "pitch" of the thumb hole 14 or the recess 28. "Pitch" is defined as the angular and linear differences of the longitudinal axis of a hole or cavity with respect to the center of the ball 12.

Figure 5:
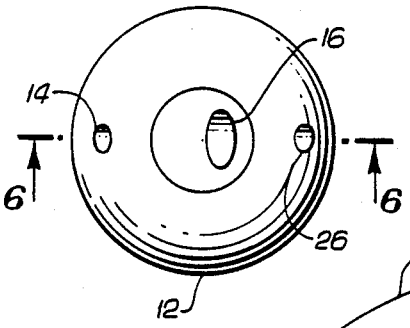
FIG. 5 is a perspective view of an alternative embodiment of the improved gripping arrangement of this invention.
Figure 6:
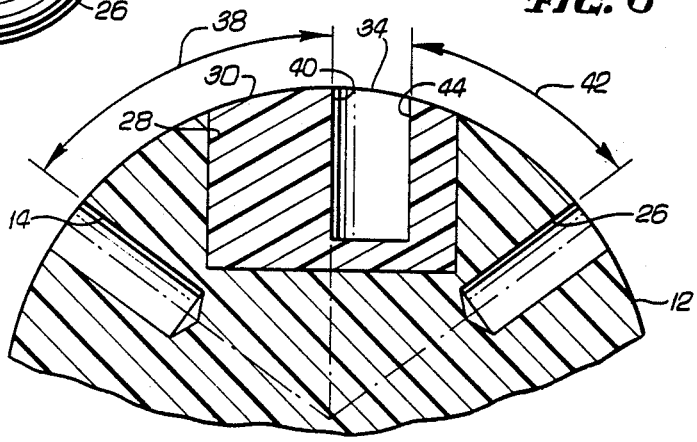
FIG. 6 is an enlarged fragmented sectional view taken generally along line 6—6 of FIG. 5, illustrating the relationship of the thumb holes and the elliptical cavity with respect to one another and the center of the bowling ball.

In a second embodiment, best illustrated by FIGS. 5 and 6, a second thumb hole 26 is situated diametrically opposite the first thumb hole 14 with respect to the recess 28. When the plug 30 is inserted into the recess 28, the cavity 16 is positioned so that it is bisected by a plane running from the longitudinal axis of the first thumb hole 14 through the longitudinal axis of the second thumb hole 26.

By situating the cavity 16 upon the spherical ball 12, as illustrated in FIG. 6, so that it is positioned differently with respect to the two different thumb holes 14 and 26, different performance characteristics may be obtained from a single housing ball 12. When so positioned, an angle 38 between the first thumb hole 14 and a first lifting edge 40 of the cavity 16 may be different than an angle 42 between the second thumb hole 26 and a second lifting edge 44 of the cavity. Also, the "pitch" of the cavity 16 with respect to each thumb hole 14 and 26 can be different.

Should a bowler become dissatisfied with a conventional three-holed ball, the invention provides a simple and expedient technique by which the ball can be converted to an improved and more useful ball 12 by the addition of the plug 30 containing the elliptical cavity 16. This is accomplished by drilling to form the recess 28 over the location of the existing finger holes without interfering with the integrity of the existing thumb hole 14. A plug similar to the illustrated plug 30 fills the recess 28. The position of the plug 30 is adjusted to accommodate the bowler's fingers 22 and 24 within the cavity 16 when the thumb 18 is placed within the existing thumb hole 14 and when satisfactorily positioned, and the plug is bonded to the ball 12 to form an integral unit. Additionally, the second thumb hole 26 can be drilled diametrically opposite the first thumb hole 14 with respect to the recess 28 and positioned to allow the bowler an alternate grip.

Finally, it should be noted that in either of the above embodiments one plug 30 may be removed and repositioned or replaced with another.

It will be appreciated from the foregoing that the present invention represents an important advance in the bowling ball art. With this unique grip arrangement, which utilizes an elliptical finger cavity, the individual lifting forces of the bowler's fingers are merged into a single lifting force directed toward the thumb. Differences between finger spans are accomodated by the curved lifting edge of the cavity which allows each fully spanned finger to be met by the wall of the cavity at its most natural point. The feeling of control during delivery of the bowling ball and associated performance characteristics are enhanced by dimensioning and shaping the cavity so that the back sides of the lifting fingers are in loose contact with the back side of said cavity.

Additionally, the cavity may be located to allow the bowler to select the desired "pitch" and whether a conventional grip, finger tip grip, or semi-finger tip grip will be used. This last mentioned feature is especially important for those weaker adults and children who desire the bowling action provided by the finger tip grip yet lack the strength to control the ball with such a grip. These bowlers must typically use a conventional grip in which the first and second phalanges of the lifting fingers are fully inserted into the finger holes. The semi-finger tip grip, a feasible alternative through the use of the elliptical finger cavity as described herein, allows those less strong persons to insert the first phalange and only part of the second phalange of the lifting fingers into the cavity, thereby providing the bowler with a sufficient feeling of control as well as providing some of the bowling characteristics traditionally associated only with the finger tip grip.

Although particular embodiments of the invention have been described in detail for purposes of illustration, various modifications may be made without departing from the spirit and scope of the invention. Accordingly, the invention is not to be limited, except by the appended claims.

I claim:

1. A bowling ball comprising:

a spherical body of suitable size, weight and construction for use as a bowling ball;

a first hole extending into said body from the surface thereof and suitable for the insertion of a bowler's thumb therein; and a second hole extending into said body from the surface thereof and suitable for the insertion of two fingers therein, said second hole being elongated to accept said fingers in a side by side relationship and presenting to said fingers on the side of said second hole closest to said first hole a concave finger contact surface that in cross-section forms part of an ellipse, said second hole having a longitudinal axis and being oriented such that said axis is bissected by a line proceeding perpendicular to said axis from the center of said first hole, whereby lifting forces generated at said second hole are merged into a single force directed toward said first hole.

2. The bowling ball of claim 1 wherein said second hole is elliptical in cross-section.

3. The bowling ball of claim 1 wherein said first hole is circular in cross-section.

4. The bowling ball of claim 1 wherein:

said first hole is circular in cross-section; and said second hole is elliptical in cross-section.

5. The bowling ball of claim 1 further comprising a separately formed plug contained in said body and defining said second hole.

6. The bowling ball of claim 1 further comprising a third hole on the opposite side of said second hole from said first hole and suitable for the insertion of a bowler's thumb therein.

7. A bowling ball comprising:

a spherical body of suitable size, weight and construction for use as a bowling ball;

a first hole that is circular in cross-section extending into said body from the surface thereof and suitable for the insertion of a bowler's thumb therein;

a second hole extending into said body from the surface thereof and suitable for the insertion of two fingers therein, said second hole being elliptical and dimensioned to accept said fingers in a side by side relationship; and a third hole that is circular in cross-section extending into said body from the surface thereof and suitable for the insertion of a bowler's thumb therein, said third hole being positioned on the opposite side of said second hole from said first hole;

said holes being arranged such that a line connecting the centers of said first and third holes bisects the major axis of said second hole and is perpendicular thereto.

* * * * *